US006494539B2

(12) United States Patent
Frank

(10) Patent No.: US 6,494,539 B2
(45) Date of Patent: Dec. 17, 2002

(54) CHAIR WITH A FOLDING BACKREST AND A HINGE THEREFOR

(76) Inventor: Charlotte E. Frank, 282 Leila Avenue, Winnipeg, Manitoba (CA), R2V 1L8

( * ) Notice: Subject to any disclaimer, the term of this patent is extended or adjusted under 35 U.S.C. 154(b) by 0 days.

(21) Appl. No.: 09/803,656

(22) Filed: Mar. 12, 2001

(65) Prior Publication Data

US 2002/0113474 A1 Aug. 22, 2002

(51) Int. Cl.[7] ..... B60N 2/02
(52) U.S. Cl. ..... 297/378.1; 297/378.14
(58) Field of Search ..... 297/378.1, 378.14, 297/378.12

(56) References Cited

U.S. PATENT DOCUMENTS 878,889 A * 2/1908 Miller ..... 297/378.1 X
2,400,630 A * 5/1946 Cramer et al. ..... 297/378.12
2,711,785 A * 6/1955 Moller ..... 297/378.1 X

* cited by examiner

*Primary Examiner*—Rodney B. White
(74) *Attorney, Agent, or Firm*—Adrian D. Battison; Michael R. Williams; Ryan W. Dupuis

(57) ABSTRACT

A chair primarily for a fishing boat has a chair seat having a seat base plate for attachment to a swivel support with a seat pad and a seat back having a back plate and a back pad. The back plate is connected to the seat base plate by two hinges which allow folding of the seat back onto the base. In order to accommodate the high forces from an occupant leaning against the seat back while riding over rough water at high speed the hinge includes a spring steel strap fastened to the seat base plate and extending up behind the seat base plate to a top edge above the seat pad which can flex to take up the forces. A hinge plate is attached to the back plate and extends therefrom downwardly into contact with the spring strap connected together by a hinge pin defining a horizontal hinge axis. The hinge plate includes a rear tab extending along a rear of the spring strap for communicating forces from the person leaning backward through the hinge to the flexing of the strap. The pin is held in place within loops at the strap and the hinge plate by a central circlip between two loops of the strap which are aligned with the tab of the hinge plate.

7 Claims, 4 Drawing Sheets

CHAIR WITH A FOLDING BACKREST AND A HINGE THEREFOR

This invention relates to a chair with a folding back and to a hinge which can be used to pivotally mount the folding back on the chair seat for folding of the chair back onto the chair seat and for resilient spring movement of the chair back relative to the chair seat.

BACKGROUND OF THE INVENTION

Chairs primarily for fishing boats often include a chair seat which is attached to a swivel mount by a base plate so that the occupant can swivel to different directions for travel from one fishing spot to another and for movement in fishing. The chairs generally also includes a seat back against which the occupant can rest during riding from one spot to another and during fishing. High speed travel across the water often includes some vertical vibrations which cause significant loads to be transferred from the occupant to the chair. In a situation where the occupant is leaning backwards, the weight from the occupant is heavily pressed against the back rest often damaging the structure.

In addition it is desirable in a fishing boat of this type to provide a chair back which can fold downwardly onto the seat so that the seat back of unused seats does not detract from or interfere with the vision of the occupants of the boat.

Hinges to date have little resilience so that all of the loading from the occupant due to leaning or vibration is applied to the hinge so that damage regularly occurs.

SUMMARY OF THE INVENTION

It is one object of the present invention therefore to provide a chair which allows folding of a seat back onto the seat base and also accommodates the forces from the occupant leaning backward onto the seatback.

According to one aspect of the invention there is provided a chair comprising:

- a chair seat having a seat base plate for attachment to a support for holding the seat base plate generally horizontal;
- a seat pad mounted on the base plate on which a person can sit;
- a seat back having a back plate and a back pad against which a back of the person can rest;
- and at least one hinge member connecting the back plate to the seat base plate, the hinge member comprising:
- a spring strap fastened to the seat base plate and extending up behind the seat base plate to a top edge above the seat pad;
- a hinge plate attached to the back plate and extending therefrom downwardly into contact with the spring strap;
- a hinge pin defining a horizontal hinge axis;
- the hinge plate and the spring strap being shaped to define a hinge around the hinge pin;
- the hinge plate and the spring strap being shaped to allow the seat back to fold down into a folded position onto the seat pad and being shaped to prevent movement of the seat back rearwardly beyond a raised position such that forces from the person leaning backward on the seat back are communicated through the hinge into spring movement of the spring strap.

Preferably one of the strap and the hinge plate includes a rear tab extending along a rear of the other for communicating forces from the person leaning backward.

According to a second aspect the invention provides a hinge which can be used to attach the back to the seat of an existing chair, the hinge being as defined above.

BRIEF DESCRIPTION OF THE DRAWINGS

One embodiment of the invention will now be described in conjunction with the accompanying drawings, in which.

In the drawings like characters of reference indicate corresponding parts in the different figures.

DETAILED DESCRIPTION OF PREFERRED EMBODIMENTS

Figure 1:
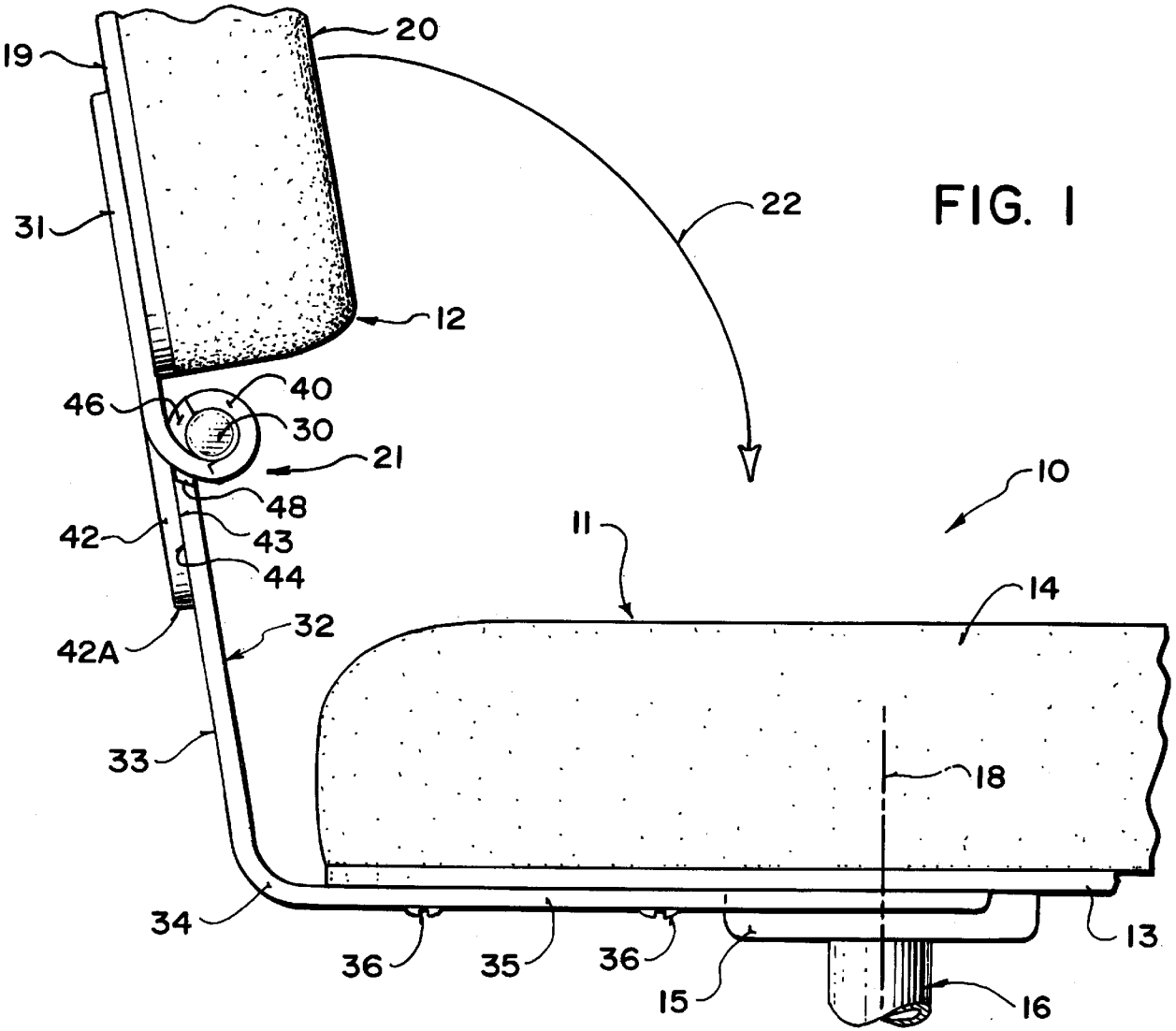
FIG. 1 is a side elevational view of a chair including a hinge according to the present invention.
Figure 2:
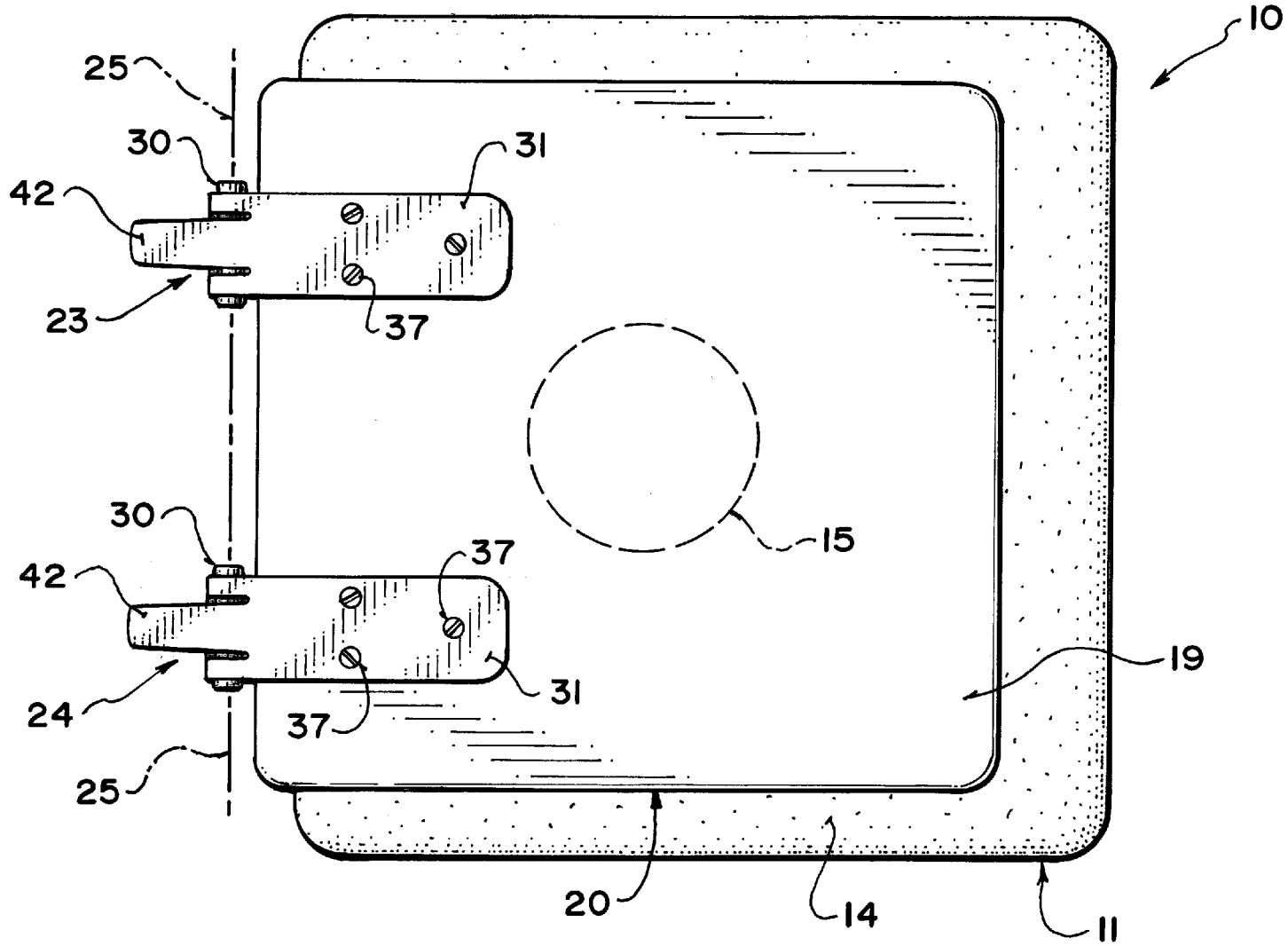
FIG. 2 is a top plan view of the chair in the folded position.

A chair 10 as shown in FIGS. 1 and 2 include the chair seat 11 and a seat back 12. The seat 11 includes a base plate 13 and a covering pad 14 on which the occupant sits. The base plate is attached to a swivel mount 15 carried on a pedestal 16 to allow the base plate to rotate about a vertical axis 18.

The seat back 12 includes a back plate 19 and a back pad 20 carried by the plate.

The present invention is concerned with a mounting and hinge structure 21 which attaches the seat back to the seat base to provide resilience and to provide a folding action by which the seat back can be folded as indicated at 22 from the raised position shown in FIG. 1 to a folded position shown in FIG. 2.

The mounting 21 is formed by two hinges 23 and 24 each arranged adjacent a respective side of the seat back and the seat base so the hinges combine to allow folding action about a horizontal folding axis 25.

Each hinge comprises a hinge pin 30 lying on the axis 25. The hinge pin hingedly connects a hinge plate 31 to a spring strap 32. The spring strap 32 extends from the pin 30 downwardly in a first section 33 to a bottom corner 34 and then extends forwardly in a horizontal section 35 fastened by screws 36 to the base plate 13. The portion 33 is spaced rearwardly from the seat pad 14 so that it can flex freely. The spring strap is formed from spring steel which is tempered to provide the required strength but allows flexing at the corner 34 and in the rear section 33 so that the hinge pin 30 can move forwardly and rearwardly in a resilient suspension action.

The hinge plate 31 is similarly fastened to the back plate 19 by screws 37.

Figure 3:
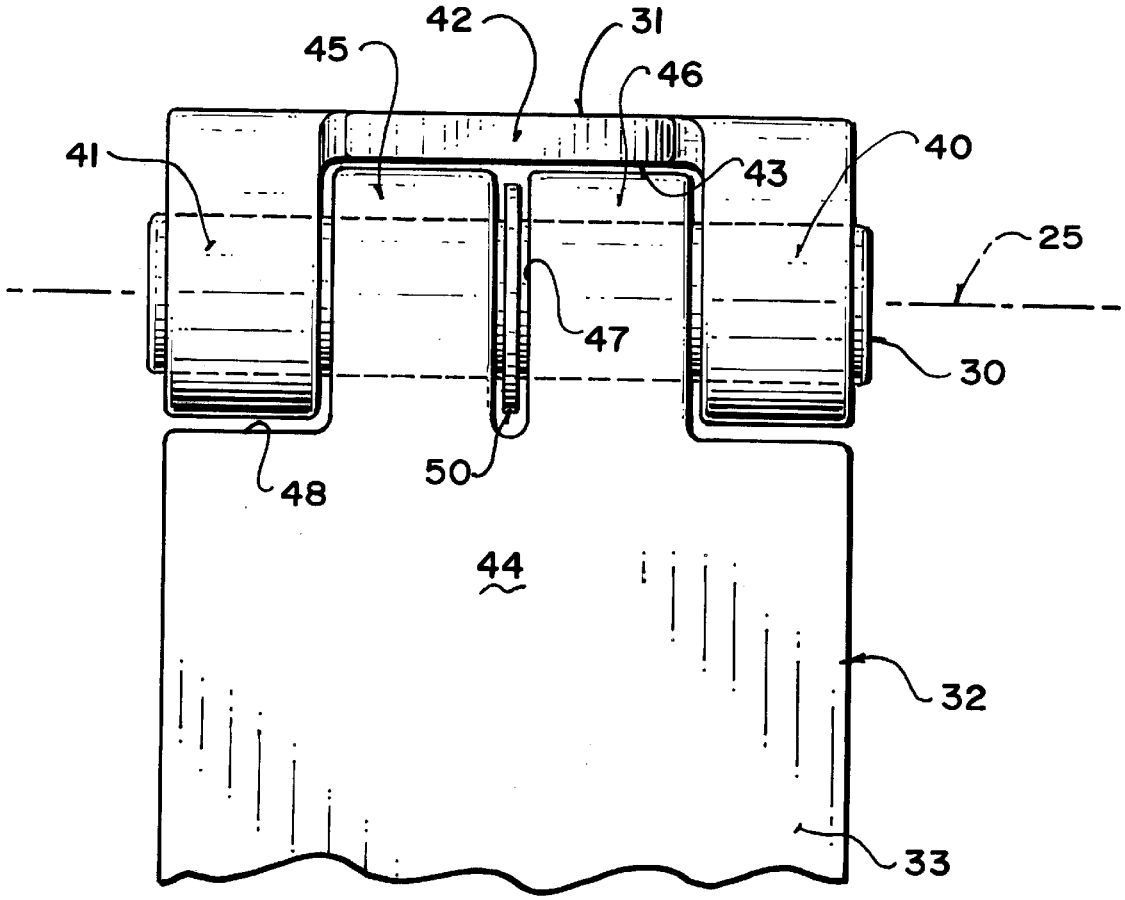
FIG. 3 is a rear elevational view of the hinge only in the folded position.
Figure 4:
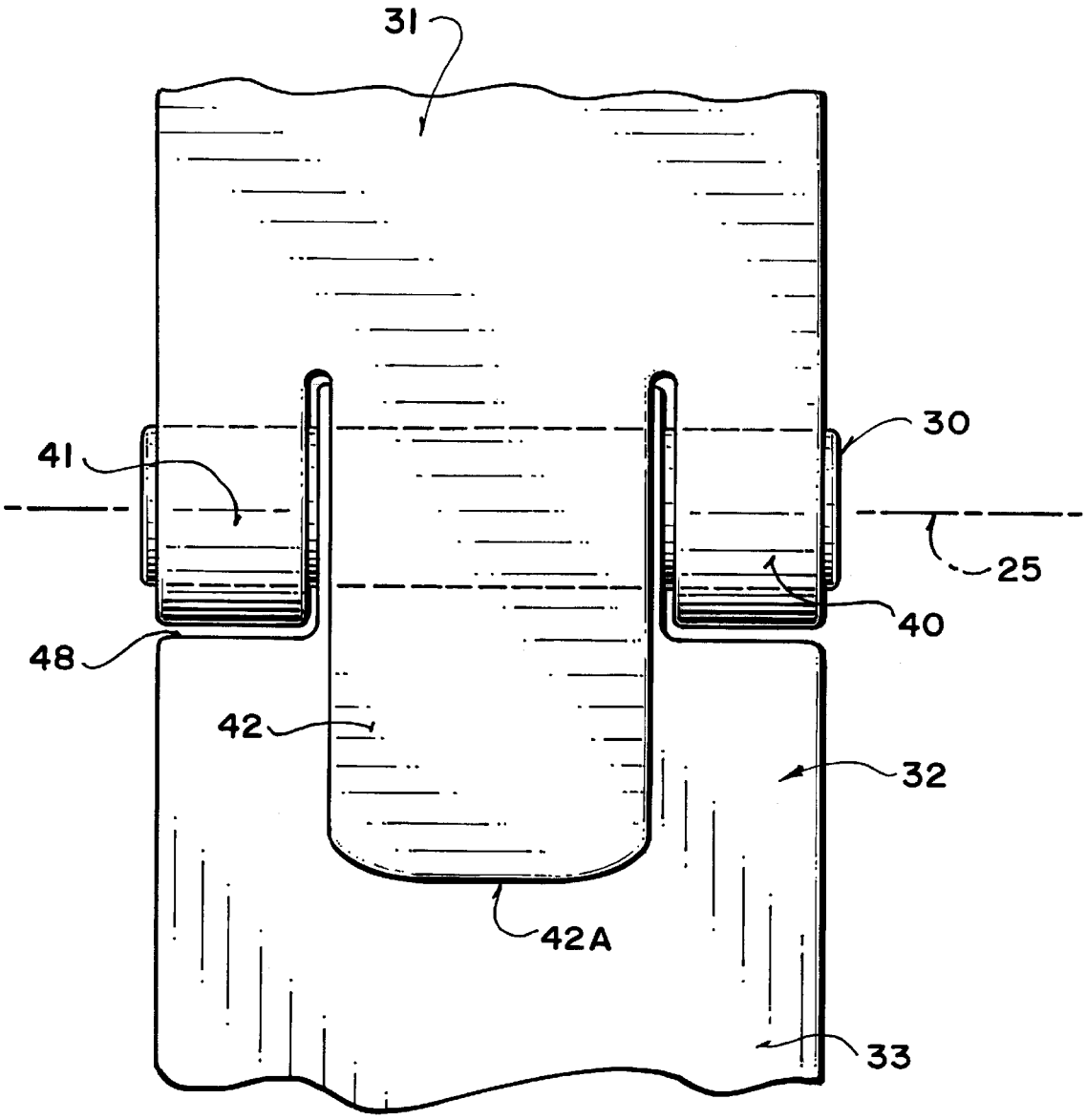
FIG. 4 is a rear elevational view of the hinge only in the extended position.

As shown in FIGS. 3 and 4, the hinge plate 31 includes two outer loops 40 and 41 which extend from the hinge plate forwardly and wrap around the pin 30 so as to locate the pin on the hinge plate forwardly of the hinge plate. In between the two loops, the hinge plate includes a tab 42 which remains co-planar with the main body of the hinge plate 31 and thus extends downwardly behind the planar main body 33 of the spring strap. Thus the tab 42 has a front surface 43 which abuts a rear surface 34 of the spring strap. The tab is of sufficient length so as to communicate the forces from the hinge plate into the spring strap. It will be noted therefore that in the raised position of the seat back, the tab presses against the spring strap but in the folded position shown in FIG. 2, the tap projects outwardly away from the spring strap. The tab therefore has no effect on the folding action except that when in the raised position it allows communication of forces down the hinge plate 31 and into the spring strap.

The spring strap includes also two loops 45 and 46 separated by a groove 47. Each loop extends upwardly from the top edge 48 of the spring strap around the pin 30 in a direction opposite to that of the loops 40 and 41 so as to locate the pin 30 at the top of the spring strap. The loops 45 and 46 are aligned with the tab 42 so that the combined width of the loops is equal to the width of the tab.

In the groove 47 is located a circlip 50 which engages a groove in the pin 30 so as to locate the pin against axial movement within the loops. The circlip butts against the inner faces of the loop 45 and 46. The top edge 48 is located just underneath the loops 40 and 41 so that the whole of the area between the top edge 48 of the spring strap and the bottom edge 42A of the tab is overlapped to provide the communication of forces between the two elements.

The device can therefore accommodate significant loads by a heavy occupant leaning backwards since those loads are primarily communicated through the hinge and into the flexing action of the spring strap. This is particularly effective where the occupant is leaning backwards while vertical vibration within the boat caused by high speed travel acts to flex the spring strap.

The hinge can be used for manufacture of new chairs or can be used as a retrofit to replace broken chairs where the existing hinge has broken due to overloading.

Since various modifications can be made in our invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A chair comprising:

a chair seat having a seat plate for attachment to a support for holding the seat base plate generally horizontal;

a seat pad mounted to the base plate on which a person can sit;

a seat back having a back plate and a back pad against which a back of the person can rest;

and two separate hinge members arranged side by side and connecting the back plate to the seat, the separate hinge members each comprising:

a spring strap fastened to the seat base plate with the strap being bent to extend up behind the seat base plate to a top edge above the seat pad;

a hinge plate attached to the back plate and extending therefrom downwardly into contact with the spring strap;

and a hinge pin defining a horizontal hinge axis;

wherein the hinge plate and the spring strap of each hinge member are each bent to define a respective sleeve portion surrounding the hinge pin for movement about the hinge axis to allow the seat back to fold down into a folded position onto the seat pad;

wherein the hinge plate and the spring strap of each hinge member is shaped to prevent movement of the seat back rearwardly beyond a raised position;

and wherein the spring straps of each hinge member are arranged such that the forces from the person leaning backward on the seat back are communicated through the hinge into spring flexing movement of the spring straps.

2. The chair according to claim 1 wherein one of the strap and the hinge plate includes a rear tab extending along a rear of the other for communicating forces from the person leaning backward.

3. The chair according to claim 2 wherein an upper part of the spring strap is bent around the hinge axis to define said sleeve portion surrounding the hinge pin and a lower part of the hinge plate is bent around the hinge axis to define said sleeve portion surrounding the hinge pin with the sleeve portion of the spring strap and the sleeve portion of the hinge plate being arranged co-axially at the hinge pin and wherein the rear tab is formed by a portion of either the upper part of the spring strap or the lower part of the hinge plate at the sleeve portion thereof which extends beyond the hinge pin.

4. The chair according to claim 3 wherein the rear tab is arranged on the lower portion of the hinge.

5. The chair according to claim 3 wherein the sleeve portion of the hinge plate has two outer loops surrounding the hinge pin and the sleeve portion of the spring plate has a loop between the outer loops and wherein the rear tab is arranged on the lower portion of the hinge plate between the two outer loops.

6. The chair according to claim 1 wherein the sleeve portion of the hinge plate or the sleeve portion of the strap has two outer loops surrounding the pin and the other of the sleeve portions has a loop inwardly of the outer loops also surrounding the pin and wherein the pin is held against axial movement by a circlip between the two outer loops.

7. The chair according to claim 6 wherein the other of the sleeve portions includes two separated loops between the outer loops where the circlip is located between the two separated loops.

* * * * *